US005155885A

United States Patent [19]

Jyouraku et al.

[11] Patent Number: 5,155,885

[45] Date of Patent: Oct. 20, 1992

[54] VACUUM CLEANER AND METHOD FOR OPERATING THE SAME

[75] Inventors: Fumio Jyouraku; Yoshitaro Ishii; Hisao Suka; Kazuo Tahara, all of Hitachi; Haruo Koharagi, Juuou, all of Japan

[73] Assignee: Hitachi, Ltd., Tokyo, Japan

[21] Appl. No.: 416,829

[22] Filed: Oct. 3, 1989

[30] Foreign Application Priority Data

Oct. 7, 1988 [JP] Japan ..... 63-251816
Mar. 18, 1989 [JP] Japan ..... 1-66723

[51] Int. Cl.[5] ..... G05D 7/06

[52] U.S. Cl. ..... 15/319; 15/339; 15/404

[58] Field of Search ..... 15/300 R, 319, 339, 15/404

[56] References Cited

U.S. PATENT DOCUMENTS

| | | | |
|---|---|---|---|
| 1,904,973 | 4/1933 | Smellie | 15/319 |
| 2,789,660 | 4/1957 | Brown | 15/319 X |
| 3,577,869 | 5/1971 | Tomoyoki et al. | 15/319 X |
| 4,021,879 | 5/1977 | Brigham | 15/319 |
| 4,399,585 | 8/1983 | Kullik et al. | 15/319 |
| 4,580,311 | 4/1986 | Kurz | 15/319 |
| 4,601,082 | 7/1986 | Kurz | 15/319 |
| 4,654,924 | 4/1987 | Getz et al. | 15/319 |

FOREIGN PATENT DOCUMENTS

| | | | |
|---|---|---|---|
| 0264728 | 4/1988 | European Pat. Off. . | |
| 1920640 | 11/1970 | Fed. Rep. of Germany . | |
| 1954700 | 5/1971 | Fed. Rep. of Germany . | |
| 2032476 | 1/1972 | Fed. Rep. of Germany . | |
| 3225463 | 1/1984 | Fed. Rep. of Germany | 15/319 |
| 8901003 | 5/1989 | Fed. Rep. of Germany . | |
| 0203462 | 10/1983 | German Democratic Rep. | 15/319 |
| 0063558 | 5/1979 | Japan | 15/319 |
| 61-280831 | 12/1986 | Japan . | |
| 2081936 | 2/1982 | United Kingdom | 15/319 |

*Primary Examiner*—Ernest G. Cusick
*Attorney, Agent, or Firm*—Antonelli, Terry, Stout & Kraus

[57] ABSTRACT

An output of a electric driven blower in a cleaner main body is controlled in response to a detection value of a pressure sensor which detects an operation condition in the cleaner main body. A change-over level setting value is provided as a control value for the sensor so as to form a judgment point for changing over a control condition of the blower. A return level setting value is provided as a control value for the sensor so as to form a judgment point for returning to a previous control condition of the blower from a changed-over condition of the blower. When the detection value of the sensor is more than the change-over level setting value, the return level setting value is set higher than the change-over setting value, thereby the output of the blower is increased, or the return level setting value is set a lower than the change-over level setting value, thereby the output of the blower is decreased.

12 Claims, 6 Drawing Sheets

VACUUM CLEANER AND METHOD FOR OPERATING THE SAME

BACKGROUND OF THE INVENTION

The present invention relates to a vacuum cleaner having a detection sensor for detecting an operation condition, i.e. an operational parameter, of the vacuum cleaner in a cleaner main body and a method for operating a vacuum cleaner.

The present invention relates to a vacuum cleaner and a method for operating the same, the vacuum cleaner comprising a detection sensor for detecting an operation condition in the vacuum cleaner having an electric driven blower and a control portion for controlling the electric driven blower in response to a detection value of the detection sensor.

In a conventional vacuum cleaner, for example shown in Japanese Patent Laid-Open (Kokai) No. Sho 61-280831, there has been known a technique that an output of an electric driven blower in a cleaner main body of the vacuum cleaner is controlled in accordance with a detection value of a pressure sensor, which detects an operation condition of the vacuum cleaner in the cleaner main body.

In the above stated vacuum cleaner, the vacuum cleaner comprises the pressure sensor for detecting the operation condition of the vacuum cleaner having the electric driven blower and a control portion for controlling the electric driven blower in response to the detection value of the pressure sensor.

In the above stated conventional vacuum cleaner, a method for decreasing an output of the electric driven blower at the operation range in a side of a large air flow amount, as the characteristic motion curve line shown in FIG. 2, or a method for decreasing the output of the electric driven blower at an operation range in a side of a small air flow amount, as the characteristic motion curve line shown in FIG. 3, can be attained.

However, in case of an attempt for an electric power saving or a noise reduction by decreasing the output of the electric driven blower at both the large air flow amount side and the small air flow amount side which are positioned respectively outside of the practical cleaner operation range, it is necessary to change over at a side of a directly-opposed characteristic as an algorithm.

However, it is difficult to attain with only one pressure sensor and it is necessary to make a combination of a plurality of pressure sensors or the different kinds pressure sensors, thereby it brings a defect that it becomes a complicated cleaner main body structure using a plurality of the pressure sensors.

Further, in case of a negative gradient control in regards to the characteristics of an air flow amount and a static pressure with respect to the electric driven blower, which is shown at A portion in the characteristic motion curve line in FIG. 4, it cannot adopt to in a practical use.

Because it causes a circulation control or a chattering phenomenon which comprises an increase in the static pressure over a change-over setting point (or a move toward the small air flow amount side), a lowering control for the output of the electric driven blower, a decrease in the static pressure below the change-over setting point, and a control for returning to a previous control condition.

In the conventional vacuum cleaner, in case of the output for decreasing in the electric driven blower, the return level and the change-over level have almost value. Also, the change-over level setting point and the new motion point go and return on the same load curve line. Accordingly, the chattering phenomenon occurs in the conventional vacuum cleaner.

Further, due to a method for detecting a pressure value, a control change-over point in case of the air flow amount varying from a large air flow amount side to a small air flow amount side differs to a return control change-over point in case of the air flow amount varying from the small air flow amount side to the large air flow amount side, namely a hysteresis phenomenon occurs, therefore it is difficult to carry out the control for the output in the electric driven blower with a high accuracy.

Namely, in the conventional method for operating the vacuum cleaner, in case of the output for increasing in the electric driven blower, unless it returns to a return point which becomes the same pressure value as that of the pressure value at the change-over level setting point, it does not return to the previous control condition. The air flow amount at the change-over level setting point in the forth passage differs to the air flow amount at the return point in the back passage, accordingly the hysteresis phenomenon occurs in the conventional vacuum cleaner.

Further, in the conventional vacuum cleaner, the electric driven blower generates a negative pressure according to a high speed rotation of a centrifugal fan by an electric motor and causes a suction force. In an aerodynamic characteristic of the electric driven blower in the cleaner main body as motion curve lines shown in FIG. 5, in case that it is driven by an electric motor having a series characteristic such as a commutator motor, since the load thereof becomes light at a small air flow amount side, a rotation number N rises, also a static pressure H rises. Besides, the consumption electric power W reduces.

Further, even when the electric driven blower is driven at a constant speed with a synchronous motor or an induction motor, as motion curve lines shown in FIG. 6, at the small air flow amount side it shows a similar tendency to that of FIG. 5, this tendency becomes remarkable in this case.

Namely, the above stated rotation number N is constant, an increase rate in the static pressure H reduces at the small air flow amount side, a decrease rate in a rotation torque becomes large, and a reduction in load becomes large. Accordingly, the decrease rates in the consumption electric power W and an electric current I become large.

In case of a variable speed operation by an inverter motor, etc., from a microscopic aspect, at each point of each of an operation condition, as motion curve lines shown in FIG. 7, it is shown with the combination of the constant speed control.

As motion curve lines shown in FIG. 8, by the operation of each portion (1), (2), (3) and (4) which is shown in the bold lines of a plurality of the constant speed characteristic motion curve lines, is changed over selectively, therefore the characteristic curve lines shown in FIG. 7 can be realized.

Now, a common point with the above stated various characteristics, as motion curve lines shown in FIG. 9, each rate of amounts $\Delta H$, $\Delta N$, $\Delta W$ etc., which is respectively a variation amount of the static pressure H, the rotation number N, or the consumption electric power W with respect to the air flow variation amount ΔQ differs to respectively at the large air flow amount side and also at the small air flow amount side.

When ΔH/ΔQ, ΔN/ΔQ, ΔW/ΔQ, and the combinations of those are detected using the pressure sensor, then a predetermined control for the vacuum cleaner can be carried out. In case that the detection sensitivity of the pressure sensor is made the same, it may carry out with an error judgment and an error control. However, in the conventional vacuum cleaner, no considerations are given to the variation rates and the control thereof.

SUMMARY OF THE INVENTION

An object of the present invention is to provide a vacuum cleaner and a method for operating the same wherein an electric driven blower installed in a cleaner main body can be operated with an optimum characteristic.

Another object of the present invention is to provide a vacuum cleaner and a method for operating the same wherein an output of an electric driven blower installed in a cleaner main body can be decreased at both a large air flow amount side and a small air flow amount side.

A further object of the present invention is to provide a vacuum cleaner and a method for operating the same wherein an output of an electric driven blower installed in a cleaner main body can be decreased using one detection sensor for detecting an operation condition of the vacuum cleaner.

A further object of the present invention is to provide a vacuum cleaner and a method for operating the same wherein a hysteresis phenomenon in an electric driven blower installed in a cleaner main body can be prevented.

A further object of the present invention is to provide a vacuum cleaner and a method for operating the same wherein a hysteresis amount in an electric driven blower installed in a cleaner main body can be adjusted.

A further object of the present invention is to provide a vacuum cleaner and a method for operating the same wherein a chattering phenomenon in an electric driven blower installed in a cleaner main body can be prevented.

A further object of the present invention is to provide a vacuum cleaner and a method for operating the same wherein an output of an electric driven blower installed in a cleaner main body can be controlled accurately in response to a cleaning condition of the vacuum cleaner.

A further object of the present invention is to provide a vacuum cleaner and a method for operating the same, wherein an error control for an electric driven blower installed in a cleaner main body, which is caused by varying a rate of each variation amount of a static pressure, a rotation number, a consumption electric power, or an electric current, etc., with respect to a variation amount of an air flow at a large air flow amount side and also at a small air flow amount side, can be gotten rid of.

According to the present invention, in a vacuum cleaner comprising a cleaner main body having a filter for catching dust and an electric driven blower in an inside portion thereof, a detection sensor for detecting an operation condition in the cleaner main body, and a control apparatus for controlling an output of the electric driven blower in response to a detection value of the detection sensor, in which as control values in accordance with the detection value of the detection sensor, a change-over level setting value for forming a judgment point for changing over a control condition of the electric driven blower and a return level setting value for forming a judgment point for returning to a previous control condition of the electric driven blower from a changed-over control condition of the electric driven blower, and an output of the electric driven blower is controlled by the change-over level setting value and the return level setting value.

When the detection value of the detection sensor is more then the change-over level setting value, the return level setting value is set higher than the change-over level setting value, thereby the output of the electric driven blower is increased. When the detection value of the detection sensor is more than the change-over level setting value, the return level setting value is set lower than the change-over level setting value, thereby the output of the electric driven blower is decreased.

According to the present invention, in a vacuum cleaner comprising a sensor for detecting an operation condition in a cleaner main body having an electric driven blower, and a control portion for controlling the electric driven blower in response to a detection value of the detection sensor, thereby a detection sensitivity of the detection sensor is varied in response to a suction air flow amount.

According to the present invention, in an output for controlling the electric driven blower, since the return level setting value can be set to a predetermined return value in response to a newly changed-over control condition, it is possible to return at a motion point which is nearly to a motion point at a change-over time, or it is possible to control the output of the electric driven blower at the same or substantially the same air flow amount area, thereby the hysteresis phenomenon in the electric driven blower can be prevented.

According to the present invention, a detection sensitivity of the detection sensor is varied in response to a suction air flow amount, and a detection output having substantially same level in the electric driven blower can be obtained at all air flow amount areas.

When a condition of a suction portion of the vacuum cleaner according to a fluctuation width and a variation pattern of the detection amount by the detection sensor is judged and an output control for the electric driven blower is carried out corresponding to this judgment, it is possible to judge accurately by using a judgment apparatus which uses the same judgment and control circuit or a small number of judgment and control circuits, or judgment programs.

Accordingly, an error control being caused by each rate of the variation amounts, which are respectively a variation amount of the static pressure, the rotation number, the consumption electric power, or the electric current with respect to the air flow variation amount at the large air flow amount side and at the small air flow amount side, and an error control of the electric driven blower due to the judgment impossibility are gotten rid of and further an output control for the electric driven blower can be carried out accurately in response to the cleaning condition.

DESCRIPTION OF THE INVENTION

Hereinafter, one embodiment of a vacuum cleaner according to the present invention will be explained referring to drawings.

Figure 1:
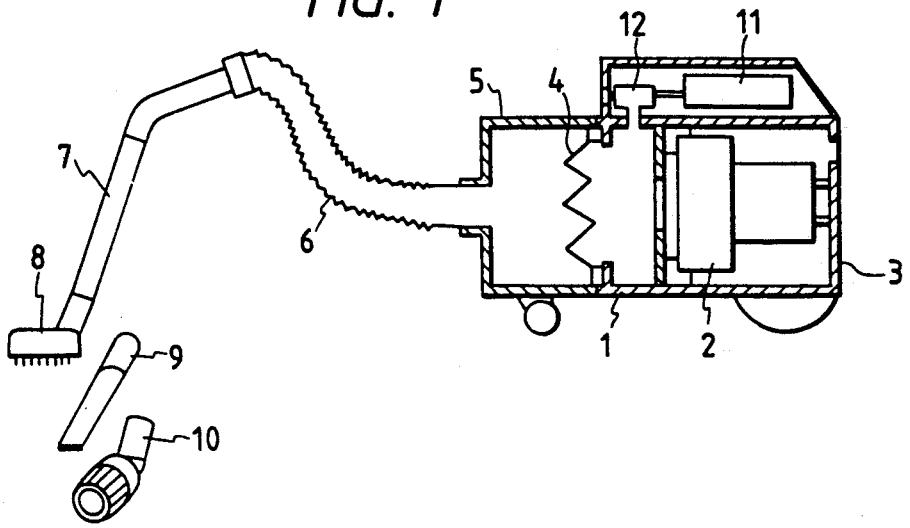
FIG. 1 is a vertical cross-sectional view showing one embodiment of an internal structure of a vacuum cleaner having an electric driven blower and a pressure sensor according to the present invention.
Figure 2:
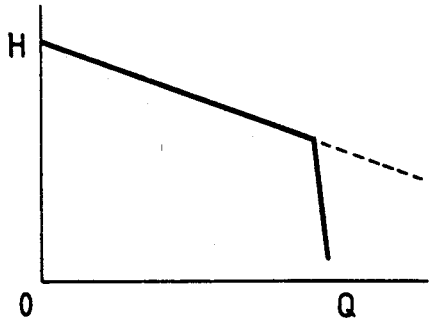
FIG. 2 (PRIOR ART)
FIG. 2 is a characteristic view showing a suction performance in a vacuum cleaner in which an output of an electric driven blower is decreased at an operation area of a large air flow amount side.
Figure 3:
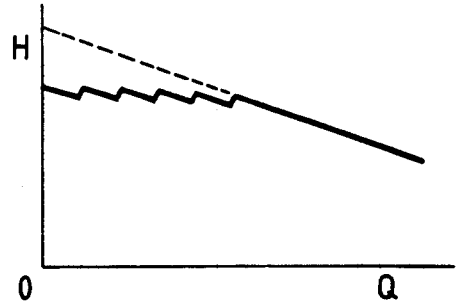
FIG. 3 (PRIOR ART)
FIG. 3 is a characteristic view showing a suction performance in a conventional vacuum cleaner in which an output of an electric driven blower is decreased at an operation area of a small air flow amount side.

In FIG. 1, a cleaner main body 1 of a vacuum cleaner comprises a main case 3 installed an electric driven blower 2 therein, and a dust case 5 installed a filter 4 for catching dust therein, and the cleaner main body 1 connects a hose 6, an extension pipe 7, and a suction nozzle 8 thereto.

The suction nozzle 8 is a general one for use in floor, and a suction nozzle 9 for use in clearance and a suction nozzle 10 for use in shelf are connected to the cleaner main body 1 as attachment parts.

A control apparatus 11 in the cleaner main body 1 is constructed of electronic circuits including a central execution processing apparatus such as electric circuits or a microcomputer and the control apparatus 11 controls an output of the electric driven blower 2 in response to a detection value of a pressure sensor 12.

The pressure sensor 12 detects an operation condition of the vacuum cleaner. A setting position of the pressure sensor 12 is positioned at a rear stream portion of the filter 4 as shown in figure, however the pressure sensor 12 may be provided suitably in the dust case 5 or at an upper stream portion of a side of the suction nozzle 8 for use in floor.

Figure 10:
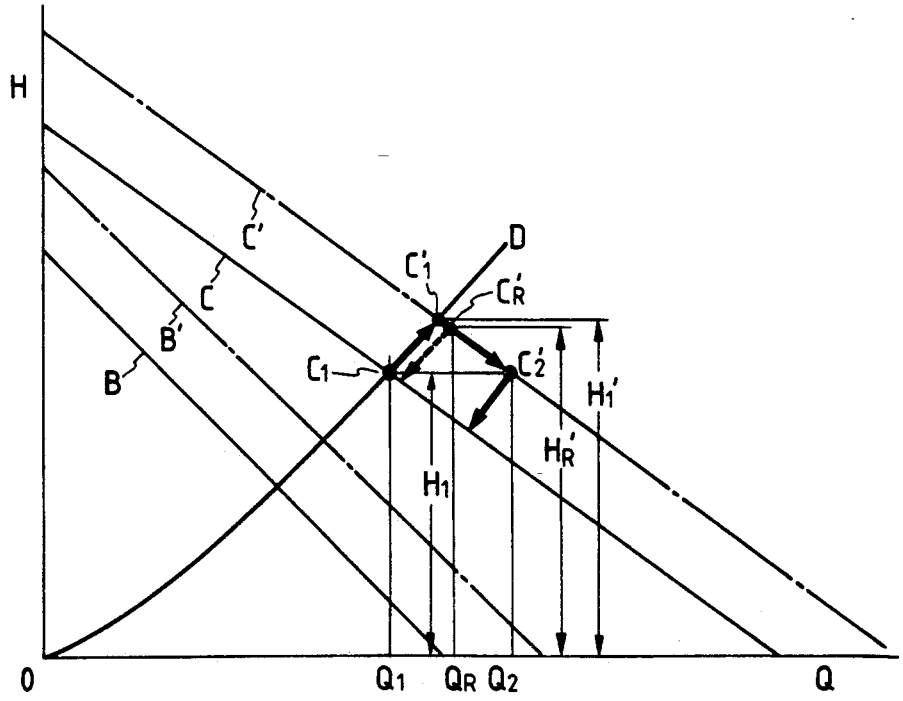
FIG. 10 is a characteristic view showing suction performances in one embodiment of a vacuum cleaner according to the present invention.

In the vacuum cleaner of the embodiment according to the present invention, a basic motion relationship or a control sequence route is shown in FIG. 10. In FIG. 10, the horizontal axis shows an air flow amount Q and the vertical axis shows a static pressure H of each portion of the vacuum cleaner, respectively. FIG. 10 is the basic motion relationship showing a method for increasing the output of the electric driven blower 2.

A motion curve line B in FIG. 10 shows a static pressure characteristic at a portion of the suction nozzle 8 for use in floor. A motion curve line C shows a static pressure characteristic detected by the pressure sensor 12 and has a larger pressure value against the motion curve line B being enough the sum part of the fluid loss in each of the portions at the filter 4, the dust case 5, the hose 6, and the extension pipe 7.

Herein, when the suction nozzle 8 for use in floor is filled up by the floor face and the static pressure H arises over a value $H_1$ of a change-over level setting point $C_1$, in case of a control for increasing an output of the electric driven blower 2, the motion curve line B and the motion curve line C change to a motion curve line B' and a motion curve line C', respectively.

A new motion point becomes an intersection point $C'_1$ with the load curve line shown in the curve line D which is the sum part of the above stated each fluid loss and the value becomes a value $H'_1$. After this, the detection pressure varies on the motion curve line C'.

However, in the conventional method for operating the vacuum cleaner, unless it returns to a return point $C'_2$ which becomes the same pressure value $H_1$ as that of the pressure value at the change-over level setting point $C_1$, it does not return to the previous control condition. The air flow amount $Q_1$ at the change-over level setting point $C_1$ in the forth passage differs from the air flow amount $Q_2$ at the return point $C'_2$ in the back passage, accordingly the hysteresis phenomenon occurs in the conventional vacuum cleaner.

In the embodiment of the present invention, as a return level setting point $C'_R$, when an approximate value $H'_R$ is set slightly smaller than the value $H'_1$ and the return control is carried out, it is possible to carry out with the control sequence route almost without the hysteresis phenomenon. At the return level setting point $C'_R$, the air flow amount has a value $Q_R$.

As a concrete return control method for operating the vacuum cleaner, each of a comparator for setting the change-over level and a comparator for setting the return level may be provided respectively and may make the logic construction using the comparators. Or by the provision of one comparator, it may make the logic construction in which, after the change-over motion, the judgment value is replaced by the return level setting value. Needless to say, using a central execution processing apparatus, the judgment function may be carried out by a program.

Figure 11:
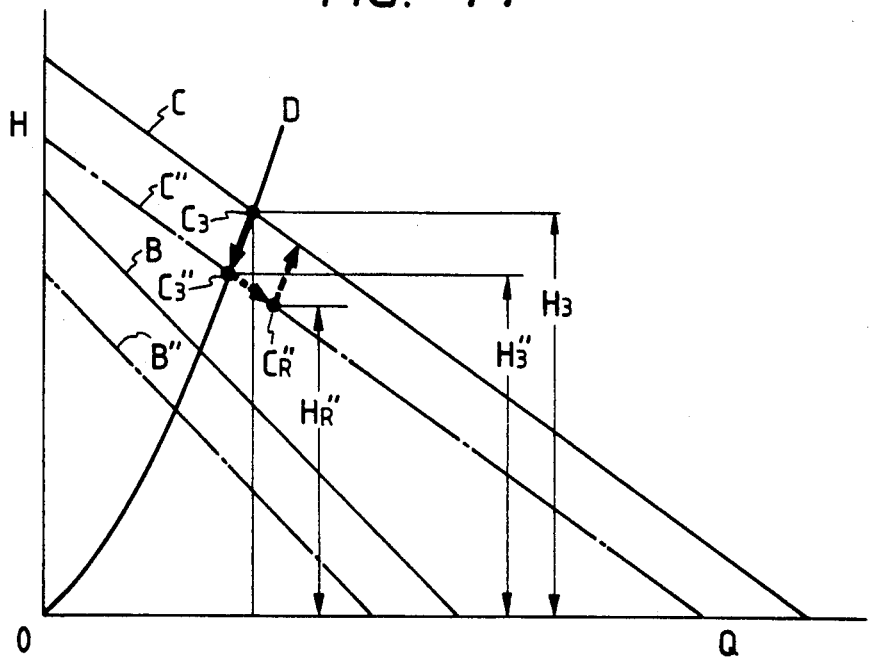
FIG. 11 is a characteristic view showing suction performances in another embodiment of a vacuum cleaner according to the present invention.

FIG. 11 is a basic motion relationship showing a method for realizing the negative gradient characteristic against the characteristic of the electric driven blower 2, namely a method for decreasing the output of the electric driven blower 2. The references of each motion curve line B, C, B″, and C″ are the same ones of the explanation shown in FIG. 10.

When it becomes over the static pressure $H_3$ at the change-over level setting point $C_3$, and a control for decreasing the output of the electric driven blower 2 is carried out, then the motion curve line B and the motion curve line C are changed to a motion curve line B″ and a motion curve line C″, respectively.

Similarly to the above stated description, a new motion point becomes a point $C''_3$ and the value of the static pressure becomes a value $H''_3$. When the control is left as it is, a control for returning to the previous motion curve line C may carry out. However in this embodiment of the present invention, as the return level setting point $C''_R$, the pressure value is set to a lower predetermined value $H''_R$ with a lower value than $H''_3$, so that it is possible to carry out the motion on the motion curve line C″.

Naturally, when the adhesion at the suction nozzle 8, etc., is released and the air flow amount Q varies to an increase side, it returns to the previous motion curve line C or a control sequence route.

Figure 4:
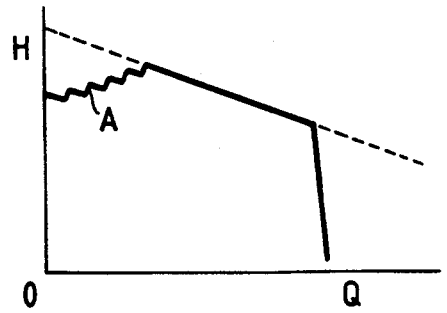
FIG. 4 is a characteristic view showing a suction performance in a conventional vacuum cleaner in which a negative gradient control for an output of an electric driven blower is carried out with respect to an electric driven blower characteristic.
Figure 5:
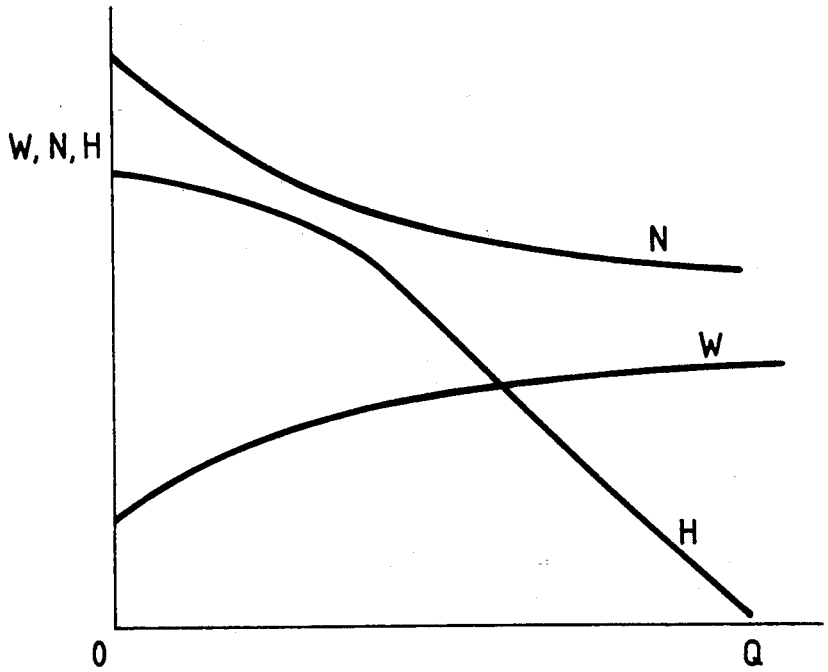
FIG. 5 is a characteristic view showing an aerodynamic performance in a vacuum cleaner in which an electric driven blower is driven by a commutator motor.
Figure 6:
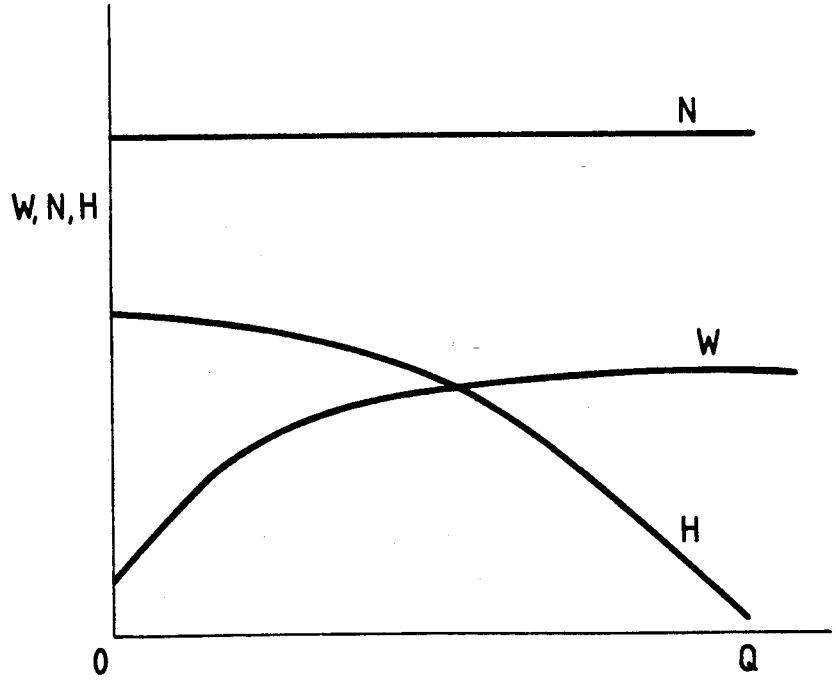
FIG. 6 is a characteristic view showing an aerodynamic performance in a vacuum cleaner in which an electric driven blower is driven by a synchronous motor or an induction motor.
Figure 7:
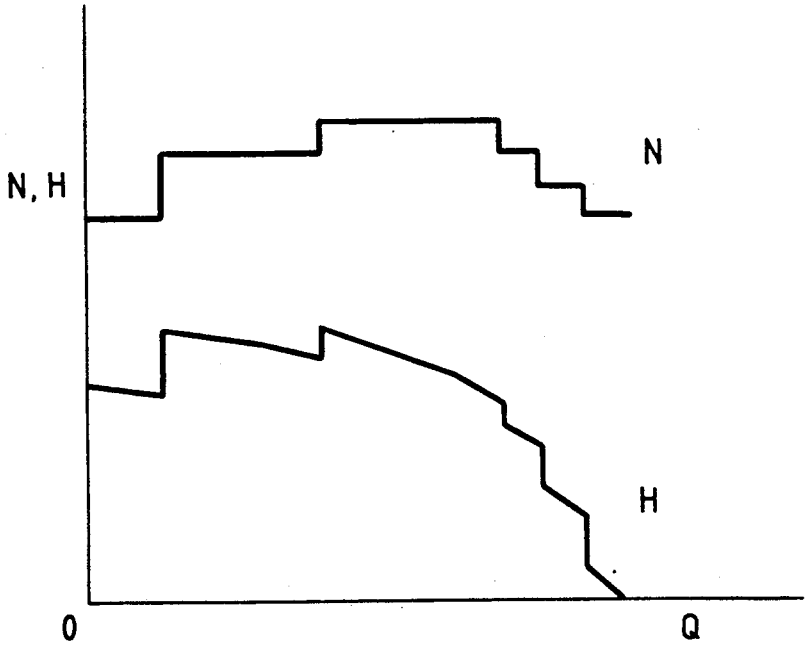
FIG. 7 is a characteristic view showing aerodynamic performances in a vacuum cleaner in which an electric driven blower is driven by an inverter motor.

By the combination of the above stated basic motions, it is possible to realize the characteristic shown in FIG. 4 by using only one pressure sensor.

Figure 12:
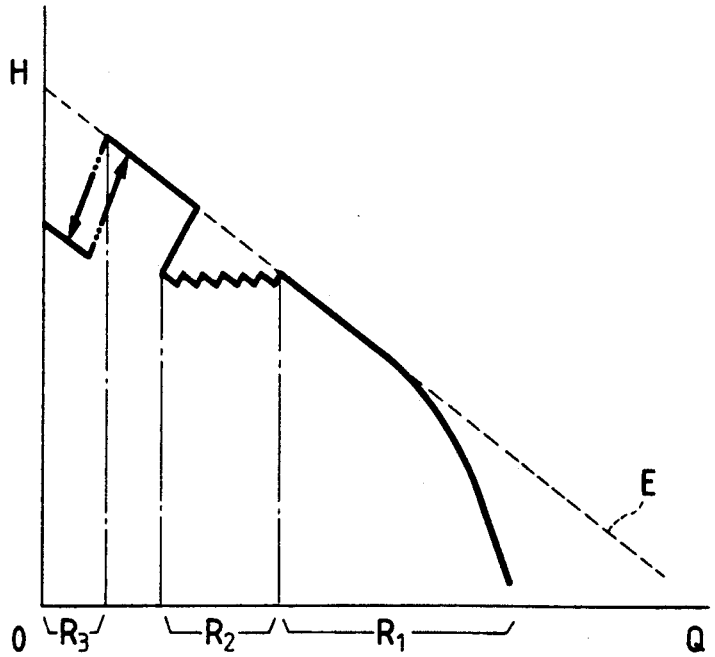
FIG. 12 is a characteristic view showing a suction performance in a further embodiment of a vacuum cleaner according to the present invention.

Further, as an applicable embodiment of the present invention, it is possible to realize to a complicated control sequence route shown in FIG. 12. In FIG. 12, one-dot line E shows a maximum output line of the electric driven blower 2.

Namely, a range $R_1$ in FIG. 12 shows a practical range for the suction nozzle 8 for use in floor and an optimum control for the vacuum cleaner is carried out.

In a range $R_2$ in which the suction nozzle 9 for use in clearance is connected to the cleaner main body 1, even only when the suction nozzle 9 for use in clearance is connected, the air flow amount Q may lower, the static pressure H may arise also. In the conventional vacuum cleaner control, even when there is no cleaning condition, it is operated with the maximum output of the electric driven blower 2, therefore it is undesirable from the aspects of the electric power saving and the noise reduction.

However, when the suction nozzle 9 for use in clearance presents an open condition, the output of the electric driven blower 2 is lowered and it is possible to control the electric driven blower 2 so far the maximum output thereof in accordance with the cleaning load condition of the suction nozzle 9 for use in clearance. Therefore it has a large effect in an improvement on the operativeness such as the electric power saving, the noise reduction, and the prevention from adhering the suction nozzle 9 for use in clearance.

Further, since it responds to the load condition of the above stated suction nozzle 9 for use in clearance, when the move and the release of the suction nozzle 9 for use in clearance are carried out rapidly and repeatedly with the cleaning face, the suction nozzle 9 for use in clearance is returned so as to present the condition that the output of the electric driven blower 2 arises to the maximum output.

Accordingly it is possible to use with the prevent of the defect in which the suction nozzle 9 for use in clearance adheres and then it causes the bad operativeness during the cleaning operation of the vacuum cleaner.

The pressure in the portion of the pressure sensor 12 can respond in the integrated style of the pressure fluctuation in the adhesion and the release of the suction nozzle portion, because a time delay for detection by rising of a total pressure due to a volume of the passage portion from the suction nozzle portion. Accordingly it can remove above stated defect in which an unnecessary rapid output variation command is given to the electric motor for driving the electric driven blower 2 by the rapid response speed.

By the provision of an orifice having a small hole to the portion of the pressure sensor 12 which acts as a dashpot, not shown in the figure, and by optimizing the response speed, the above stated operation can be utilized positively.

When the suction nozzle 9 for use in clearance is operated slowly, it can operate with a high output condition as stated above, therefore it is possible to carry out with a new use in which the suction force can be adjusted according to the operation speed of the suction nozzle 9 for use in clearance.

Further, a range $R_3$ is a nearly enclosed condition and positions an outside range against the practical range, and the output of the electric driven blower 2 is lowered as shown in FIG. 12, it is possible to prevent from adhering the suction nozzle 9 for use in clearance. When the adhesion is released, it is returned automatically to a side of a high output operation.

A characteristic shown in FIG. 12, when the parts of thereof are looked over with an enlargement, is realized in accordance with very large number of the combinations of the basic motions or control sequence routes shown in FIG. 10 and FIG. 11, however with small number of the conditions of the basic motions, the smooth motion curve line cannot obtained easily.

Practically, it can realize with a plurality of the electric circuits, however it can realize easily an ideal characteristic through the realization on the program using the combination of the central execution processing apparatus in the microcomputer.

At this time, each change-over level setting point or each return level setting point is stored as a table in the microcomputer and when a successive write-in renewal method for operating the vacuum cleaner is adopted, it can realize with a small size apparatus.

According to the above stated embodiment of the present invention, there have following effects.

It is possible to carry out the output control for the electric driven blower 2 without the hysteresis on the forth passage and the back passage by setting of the change-over level setting point and the return level setting point. Further, it is possible to use positively during the output control in the electric driven blower 2 by adjusting the amount of the hysteresis.

Even the detection value detected by only one pressure sensor 12, it is possible to realize the characteristic for the electric driven blower 2 having a negative gradient characteristic.

By the combination of the positive gradient characteristic and the negative gradient characteristic, it is possible to realize the optimum characteristic for the output control in the electric driven blower 2 by matching to the kinds of the suction nozzles and the operating conditions.

It is possible to set large number of the setting points for the change-over level and the return level in the output control for the electric driven blower 2 by the combination of the central execution processing apparatus, accordingly it is possible to realize with the optimum characteristic for operating the vacuum cleaner.

Figure 13:
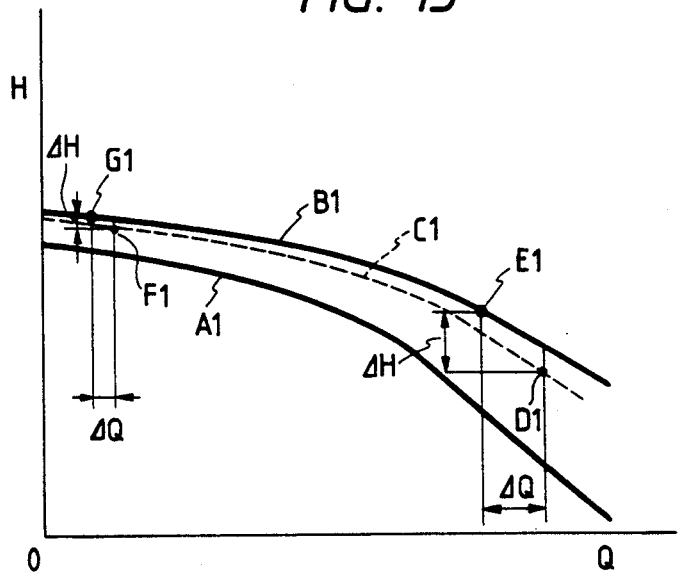
FIG. 13 is a characteristic view showing aerodynamic performances in a further embodiment of a vacuum cleaner according to the present invention.

A basic motion or a control sequence route of the vacuum cleaner is shown in FIG. 13 taking into various fluid losses. The horizontal axis in FIG. 13 shows an air flow amount Q, and the vertical axis shows a static pressure H at each portion of the vacuum cleaner.

A motion curve line $A_1$ shows a static pressure characteristic in each portion of the suction nozzle 8 for use in floor. A motion curve line $B_1$ shows a static pressure characteristic detected by the pressure sensor 12.

A motion curve line $B_1$ has a larger pressure value than that of the motion curve line $A_1$ enough sum part which is a fluid loss at the suction nozzle 8 portion, a fluid loss at the filter 4, a fluid loss at the dust case 5, a fluid loss at the hose 6, and a fluid loss at the extension pipe 7. The pressure sensor 12 detects the pressure value on the motion curve line $B_1$.

Herein, during the cleaning operation by the vacuum cleaner, when the suction nozzle 8 for use in floor is moved toward the forth direction and the back direction on the subject cleaning face or is lifted up, the fluid resistance portion of the suction nozzle 8 for use in floor fluctuates, and the pressure varies between the motion curve line $B_1$ and the motion curve line $C_1$ in FIG. 13. As the fluctuation width of the suction nozzle 8 for use in floor at this time, a difference between a point $D_1$ and a point $E_1$ is detected.

Besides, in case that the filter 4 in the cleaner main body 1 is clogged and then the motion point becomes toward the small air flow amount side, the pressure fluctuation between a point $F_1$ and a point $G_1$ in FIG. 13 is detected.

This reason is that, at the large air flow amount side, the fluctuation width at each condition is made large, namely the air flow variation amount $\Delta Q$ and the pressure variation amount $\Delta H$ are made large, because the air flow amount Q is large and the opening face of the suction nozzle 8 for use in floor varies.

Besides, at the small air flow amount side, the absolute value of the fluid loss of the suction nozzle 8 portion is small and the fluctuation width becomes small because the air flow amount Q is small.

Figure 9:
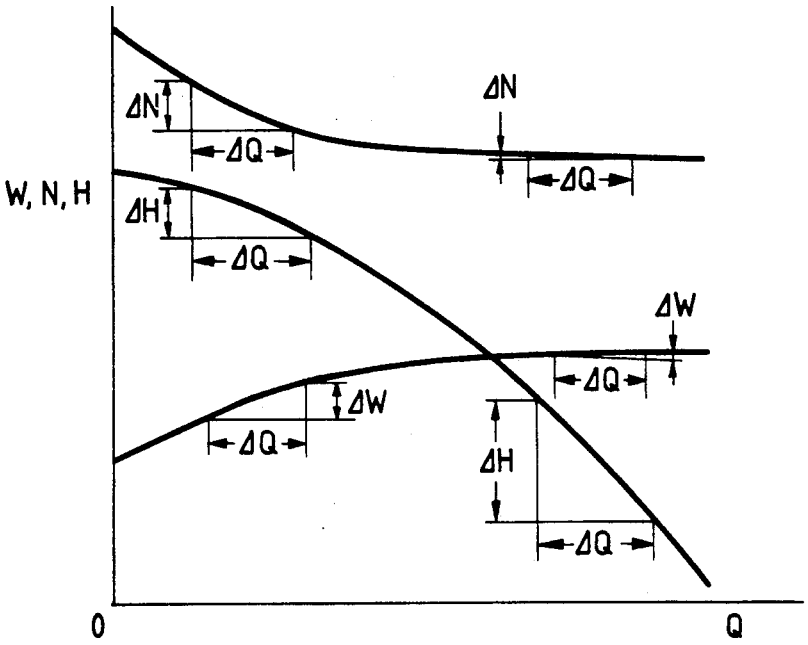
FIG. 9 is a characteristic view showing aerodynamic performances in a vacuum cleaner in which each rate of variation amounts of a static pressure, a rotation number, and a consumption electric power amount with respect to a variation amount of an air flow is indicated.

Further, as explained in FIG. 9, the fluctuation width becomes small at the small air flow amount side from the aspect of the aerodynamic characteristic of the electric driven blower 2.

Figure 14:
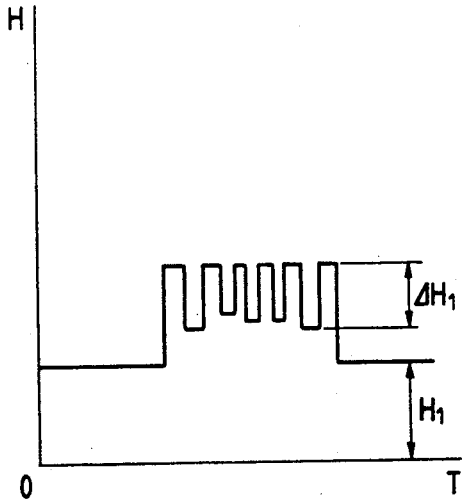
FIG. 14 is a characteristic view showing a relationship between a detection value of a static pressure by a pressure sensor and a time at an operation area of a large air flow amount side.

Herein, in the use condition at the large air flow amount side, an example of the variation of the pressure detection value $\Delta H_1$ with a time T, which is detected by the pressure sensor 12, is shown in FIG. 14.

Figure 15:
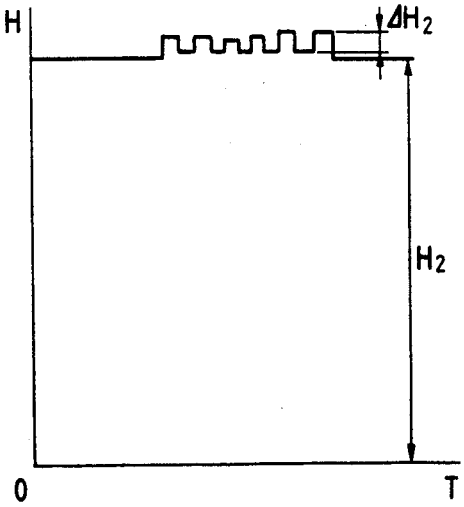
FIG. 15 is a characteristic view showing a relationship between a detection value of a static pressure by a pressure sensor and a time at an operation area of a small air flow amount side.

Further, in the use condition at the small air flow amount side, an example of the variation of the pressure detection value $\Delta H_2$ with a time T, which is detected by the pressure sensor 12, is shown in FIG. 15.

As shown in FIG. 14, at the large air flow amount side, the steady pressure value $H_1$ is small, and the fluctuation pressure value $\Delta H_1$ becomes large. The steady pressure value $H_1$ is obtained in case that the suction nozzle 8 for use in floor is lifted up in air, the fluid resistance is small, therefore no fluctuation with time occurs.

In this way, the fluctuation width and the variation time interval (variation pattern) of the pressure are detected by the pressure sensor 12, and after those are multiplied at a predetermined level and those are sent to the control apparatus 11.

The control apparatus 11, by the combination of the microcomputer and the judgment program, judges the kinds of the suction nozzles, the condition of the subject cleaning face, and the existence of the cleaning operation (the operation is carried out with the move of the suction nozzle 9 for use in clearance or not). The control apparatus 11 controls the output of the electric driven blower 2 so as to suit the cleaning condition of the vacuum cleaner and also to obtain the optimum operation condition for the vacuum cleaner.

For example, when the cleaning is carried out by lifting up the suction nozzle 8 for use in floor in air, the output in the electric driven blower 2 is lowered, therefore the low noise structure and the electric power saving can be obtained.

Besides, at the small air flow amount side, as shown in FIG. 15, the steady pressure value $H_2$ is made large by the clogging of the filter 4 etc., and the fluctuation pressure value $\Delta H_2$ becomes small. Namely, as stated above, when the cleaning condition is judged by the fluctuation width and the variation pattern of the pressure, the variation width of the pressure is very small and the judgment is difficult or becomes impossible.

Further, it presents the error judgment or it is impossible the judgment at the small air flow amount side, just as the judgment value of the judgment program is at the large air flow amount side.

As the countermeasure of this, it may had better prepare the judgment program in response to each air flow amount range, however the number of the programs corresponding to each aerodynamic characteristic becomes enormous, therefore this is not in a practical use.

Figure 8:
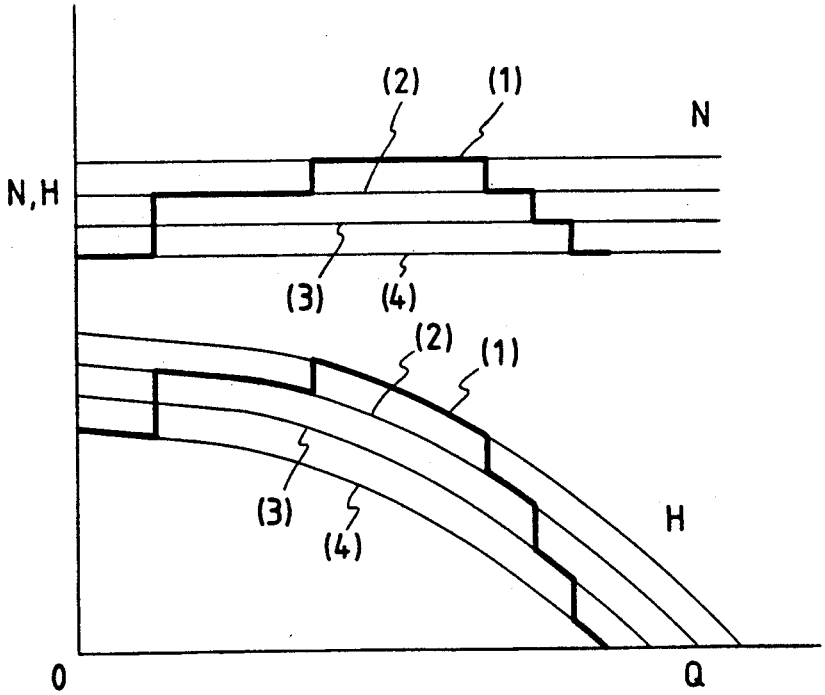
FIG. 8 is a characteristic view showing aerodynamic performances in a vacuum cleaner according to various motion curve lines in which an electric driven blower is driven by an inverter motor.

Namely, as shown in the embodiment in FIG. 8, after the operation control, it is necessary to have the judgment (value) programs in response to each air flow amount Q of each motion curve line corresponding to the aerodynamic characteristic curve lines (1), (2), (3), and (4). However, so as to carry out a highly accurate control, it is necessary to increase this number of the programs.

Besides, in this embodiment of the present invention, each of the characteristic groups as shown in the above stated FIG. 8, turning an attention that the rate $\Delta H/\Delta Q$ of the pressure amount variation $\Delta H$ in respect with the air flow amount variation $\Delta Q$ at the large air flow amount side and at the small air flow amount side, shows similarly to the same tendency, the detection sensitivity of the pressure sensor 12 varies at the small air flow amount side.

The pressure amount variation $\Delta H$, the air flow amount variation $\Delta Q$, each of which has substantially same level, or the fluctuation width of the variation rate $\Delta H/\Delta Q$ having substantially same level at all air flow amount area can be obtained by varying the detection sensitivity of the pressure sensor 12.

In this case, the fluctuation width of the output in the pressure sensor 12 at the small air flow amount side is made to have substantially same fluctuation width of the output in the pressure sensor 12 at the large air flow amount side.

In other words, the detection sensitivity of the pressure sensor 12 is varied in accordance with the suction air flow amount, the detection sensitivity having substantially same level of the pressure sensor 12 can be obtained at all air flow amount area.

When the condition of the suction opening face of the vacuum cleaner is judged according to the fluctuation width of the detection amount and the variation pattern of pressure, and when the output control in the electric driven blower 2 is carried out in response to the judgment, it is possible to judge accurately by using a judgment apparatus which uses same or small number of judgment and control circuit or judgment programs.

An error control in the electric driven blower 2 due to error judgment and judgment impossibility is gotten rid of and also an output control for the electric driven blower 2 can be carried out accurately in response to the cleaning condition of the vacuum cleaner.

As a concrete embodiment of the present invention, in a comparison with FIG. 14 and FIG. 15, it is attained by varying the detection sensitivity of the pressure sensor 12 at the small air flow amount side (in this example, to an increase direction), so as to obtain the fluctuation pressure width $\Delta H_2$ in the small air flow amount side which corresponds to the fluctuation pressure width $\Delta H_1$ in the large air flow amount side.

The above stated detection sensitivity change-over by the pressure sensor 12 is attained by detecting the predetermined air flow amount point, and corresponding to this, by varying the gain of the amplifier, which is included in the pressure sensor 12. It is possible to carry out the detection sensitivity change-over method for the pressure sensor 12 by the electric circuits constituting the change-over judgment circuit, or by the command in the microcomputer.

Further, by the detection sensitivity change-over in the pressure sensor 12, the steady pressure value part $H_2$ is amplified, however it is possible to process the execution by the electric circuits or the microcomputer, by taking out the fluctuation pressure value part remaining the steady pressure value part.

As stated above, according to this embodiment of the present invention, the detection sensitivity of the detection sensor is varied in response to a suction air flow amount, and a detection output having substantially same level for the detection sensor can be obtained at all air flow amount area.

When a condition of a suction opening face of the vacuum cleaner according to a variation width and a variation pattern of the detection amount is judged and a control is carried out corresponding to this judgment, it is possible to judge accurately by using a judgment apparatus which uses same or small number of judgment and control circuit or judgment programs.

An error control of the electric driven blower 2 due to the error judgment and the judgment impossibility is gotten rid of and an output control for the electric driven blower 2 can be carried out accurately in response to the cleaning condition.

Further, in this embodiment of the present invention, the detection of the pressure variation part by the pressure sensor 12 is given as an example of the detection of an operational parameter, however in place of this detection the air flow amount variation may be detected by using the air flow amount detection sensor.

Further, in case that the control is carried out by detecting the variation amount of the operation conditions, i.e. operational parameters, in respect to the rotation number variation, the consumption electric power variation, and the electric current variation, etc., by the difference in the variation rate at the large air flow amount side and at the small air flow amount side is equalized and detected, the same effects that of in the above stated embodiment of the present invention can be obtained.

According to this embodiment of the present invention, a detection sensitivity of the detection sensor is varied in response to a suction air flow amount, and a detection output having substantially same level can be obtained at all air flow amount area.

Further, only by the provision of the same and small number of the judgment and control circuit and the judgment programs, since it is possible to carry out the control in response to the cleaning condition having the large range, it can be simplified remarkably the circuit structure and the program structure and it can be attained the reduction in the part cost and the program making cost, accordingly it has large economical effects.

We claim:

1. A vacuum cleaner comprising:

a cleaner main body;

an electric driven blower provided in the cleaner main body, the electric driven blower being operable in at least a first control condition and a second control condition;

a pressure sensor for detecting a pressure in the cleaner main body according to a first pressure characteristic curve when the electric driven blower is operated in the first control condition, and according to a second pressure characteristic curve when the electric driven blower is operated in the second control condition, wherein a change-over level setting value is defined on the first pressure characteristic curve, and a return level setting value different from the change-over level setting value is defined on the second pressure characteristic curve; and a control apparatus provided in the cleaner main body and responsive to the pressure sensor for controlling an output of the electric driven blower to change a control condition of the electric driven blower in accordance with the pressure detected by the pressure sensor;

wherein the control apparatus controls the output of the electric driven blower to change the control condition of the electric driven blower from the first control condition to the second control condition when the pressure detected by the pressure sensor according to the first pressure characteristic curve passes the change-over level setting value, and controls the output of the electric driven blower to change the control condition of the electric driven blower from the second control condition back to the first control condition when the pressure detected by the pressure sensor according to the second pressure characteristic curve passes the return level setting value.

2. A vacuum cleaner according to claim 1, wherein the output of the electric driven blower in the second control condition is greater than the output of the electric driven blower in the first control condition, and wherein the return level setting value is greater than the change-over level setting value.

3. A vacuum cleaner according to claim 1, wherein the output of the electric driven blower in the second control condition is less than the output of the electric driven blower in the first control condition, and wherein the return level setting value is less than the change-over level setting value.

4. A vacuum cleaner according to claim 1, wherein the control apparatus is a central execution processing apparatus, and wherein the central execution processing apparatus comprises means for storing the change-over level setting value and the return level setting value.

5. A vacuum cleaner according to claim 4, wherein the central execution processing apparatus is a microcomputer.

6. A vacuum cleaner according to claim 4, wherein the output of the electric driven blower in the second control condition is greater than the output of the electric driven blower in the first control condition, and wherein the return level setting value is set to a value which is greater than the change-over level setting value.

7. A vacuum cleaner according to claim 4, wherein the output of the electric driven blower in the second control condition is less than the output of the electric driven blower in the first control condition, and wherein the return level setting value is set to a value which is less than the change-over level setting value.

8. A vacuum cleaner comprising:

a cleaner main body;

an electric driven blower provided in the cleaner main body;

a pressure sensor for detecting a pressure in the cleaner main body; and a control apparatus provided in the cleaner main body and responsive to the pressure sensor for controlling an output of the electric driven blower to change a control condition of the electric driven blower in accordance with the pressure detected by the pressure sensor;

wherein the control apparatus controls the output of the electric driven blower to change the control condition of the electric driven blower from a first control condition to a second control condition when the pressure detected by the pressure sensor passes a change-over level setting value, and controls the output of the electric driven blower to change the control condition of the electric driven blower from the second control condition back to the first control condition when the pressure detected by the pressure sensor passes a return level setting value;

wherein the electric blower produces a suction air flow, and further comprising means for varying a pressure detection sensitivity of the pressure sensor in accordance with an amount of the suction air flow produced by the electric driven blower.

9. A vacuum cleaner according to claim 8, wherein the output of the electric driven blower in the second control condition is greater than the output of the electric driven blower in the first control condition, and wherein the return level setting value is greater than the change-over level setting value.

10. A vacuum cleaner according to claim 8, wherein the output of the electric driven blower in the second control condition is less than the output of the electric driven blower in the first control condition, and wherein the return level setting value is less than the change-over level setting value.

11. A vacuum cleaner comprising:

a cleaner main body;

a suction nozzle attached to the cleaner main body;

an electric driven blower provided in the cleaner main body for producing a suction air flow through the suction nozzle, the electric driven blower being operable in at least a first control condition and a second control condition;

operational parameter detecting means for detecting an operational parameter of the vacuum cleaner which changes during manipulation of the suction nozzle by an operator, wherein the operational parameter detecting means detects the operational parameter according to a first operational parameter characteristic curve when the electric driven blower is operated in the first control condition, and detects the operational parameter according to a second operational parameter characteristic curve when the electric driven blower is operated in the second control condition, and wherein a change-over level setting value is defined on the first operational parameter characteristic curve, and a return level setting value different from the change-over level setting value is defined on the second operational parameter characteristic curve; and a control apparatus provided in the cleaner main body and responsive to the operational parameter detecting means for controlling an output of the electric driven blower to change a control condition of the electric driven blower in accordance with the operational parameter detected by the operational parameter detecting means;

wherein the control apparatus controls the output of the electric driven blower to change the control condition of the electric driven blower from the first control condition to the second control condition when the operational parameter detected by the operational parameter detecting means according to the first operational parameter characteristic curve passes the change-over level setting value, and controls the output of the electric driven blower to change the control condition of the electric driven blower from the second control condition back to the first control condition when the operational parameter detected by the operational parameter detecting means according to the second operational parameter characteristic curve passes the return level setting value.

12. A vacuum cleaner according to claim 11, wherein the operational parameter detecting means detects a pressure in the cleaner main body.

* * * * *